United States Patent [19]

Mori et al.

[11] Patent Number: 4,759,863

[45] Date of Patent: Jul. 26, 1988

[54] SILICONE-BASED WORKING FLUID COMPOSITION

[75] Inventors: Shigeru Mori; Satoshi Kuwata, both of Gunma-Ken, Japan

[73] Assignee: Shin-Etsu Chemical Co., Ltd., Tokyo, Japan

[21] Appl. No.: 136,330

[22] Filed: Dec. 22, 1987

[30] Foreign Application Priority Data

Dec. 23, 1986 [JP] Japan ..... 61-310535

[51] Int. Cl.[4] ..... C10M 105/76; C10M 131/02

[52] U.S. Cl. ..... 252/49.6; 252/78.3

[58] Field of Search .... 252/49.6, 78.3; C10M 131/00

[56] References Cited

U.S. PATENT DOCUMENTS

| | | | |
|---|---|---|---|
| 4,137,189 | 1/1979 | Halbrook et al. | 252/49.6 |
| 4,199,511 | 4/1980 | McAfee | 252/49.6 |
| 4,443,351 | 4/1984 | Keil | 252/49.6 |
| 4,537,691 | 8/1985 | Mori et al. | 252/49.6 |

*Primary Examiner*—Jacqueline V. Howard

*Attorney, Agent, or Firm*—Millen & White

[57] ABSTRACT

A silicone-based working fluid composition capable of exhibiting greatly improved performance of boundary lubrication is obtained by admixing an organopolysiloxane fluid with a specific chlorine-containing polycyclic cyclooctene compound in a specified amount. The inventive working fluid composition is useful, for example, as a damper fluid in various damper units due to the greatly improved lubrication and excellent thermal stability as a consequence of the high heat resistance of the specific additive.

5 Claims, No Drawings

SILICONE-BASED WORKING FLUID COMPOSITION

BACKGROUND OF THE INVENTION

Working fluids based on a silicone fluid as the principal constituent are hitherto used practically in various types of damper units but they are not quite satisfactory in performance because of the poor boundary lubrication of silicone fluids in gereral. For example, metal surfaces under friction with each other are subject to wearing when they are in contact with each other under revolution or vibration as in the damper units used in machines for transportation or power generators charged with a working fluid based on a silicone fluid as the major constituent so that the damper units are accompanied with a problem that the performance thereof is degraded by the increase in the consistency of the fluid caused by enterng of metallic dusts produced by abrasion. Another problem is caused by the heat of friction leading to increase in the fluid temperature so that rearrangement reaction may take place in the molecular chains of the silicone as is indicated by the viscosity decrease of the fluid consequently to cause a decrease of the output power of the damper unit below the initially desired level.

With an object to solve the above mentioned problems in silicone-based working fluids, a method has been proposed in which the silicone fluid is admixed with diesters such as dialkyl adipates, dialkyl sebacates, dialkyl azelates and the like, monoesters such as alkyl myristates, alkyl palmitates and alkyl ricinolates, dialkyl chlorendates and the like. Although the lubricity performance of a silicone fluid can indeed be improved by the addition of these additives as a consequence of their solubility to some extent in silicone fluids, a considerable increase in the temperature of the working fluid is sometimes unavoidable in the practical use thereof due to the heat of internal friction produced in the fluids per se even in the absence of wearing by friction on the metal surface so that such fluids are not serviceable as a silicone-based working fluid with a high degree of durability and heat resistance because of evaporation or decomposition due to thermal deterioration of such additives.

In addition, another proposal has been made to improve silicone fluids by adding molybdenum disulfide, which is a solid lubricant, though with an accompanying disadvantage that no stable fluid composition can be obtained thereby because of settling of the additive in the lapse of time after dispersion in the silicone fluid due to its high density of about 4.8 g/cm$^3$.

SUMMARY OF THE INVENTION

The present invention accordingly has an object to provide a silicone-based working fluid composition without the above described disadvantages and problems. The silicone-based working fluid of the invention comprises, in admixture:

(A) a conventional silicone fluid having a viscosity suitable for use in a working fluid; and (B) an amount effective to improve the boundary lubrication and durability of the working fluid of 1,2,3,4,7,8,9,10,13,13,14,14-dodecachloro-1,4,4a,5,6-,6a,7,10,10a,11,12,12a-dodecahydro-1,4:7,10-dimethanodibenzo[a,e]cyclooctene expressed by the structural formula

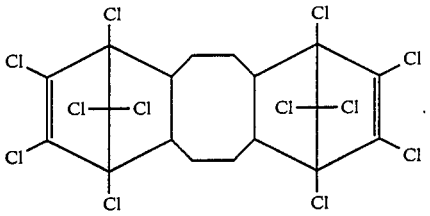

(I)

DETAILED DESCRIPTION OF THE PREFERRED EMBODIMENTS

As is described above, the inventive silicone-based working fluid is characterized by the admixture of a very specific additive compound with the base of a conventional organopolysiloxane fluid. The above specified additive compound, i.e. 1,2,3,4,7,8,9,10,13,13,14,14-dodecachloro-1,4,4a,5,6-,6a,7,10,10a,11,12,12a-dodechydro-1,4:7,10-dimethanodibenzo[a,e]cyclooctene, which is referred to as the cyclooctene compound hereinbelow, has been unexpectedly discovered as a result of the extensive investigations by the inventors undertaken with the above mentioned object. The inventors have discovered that the cyclooctene compound has little volatilizability owing to its low vapor pressure and excellent heat resistance so that the compound is hardly lost by evaporation out of the mixture. Moreover, the silicone fluid admixed with the cyclootene compound is little subject to the disavantageous effect of degradation caused by hydrogen chloride and chlorine because the cyclooctene compound is thermally stable and never produces hydrogen chloride or chlorine even in lubrication of metal surfaces. In addition, the cyclooctene compound has a relatively low density of 1.8 to 2.0 g/cm$^3$ so that it can be dispersed in a silicone fluid without settling over a long period of time. Therefore, a silicone-based working fluid with excellent durability can be obtained when comparison is made with molybdenum disulfide.

A silicone fluid suitable for use as the component (A) in the silicone-based working fluid of the invention is represented by the average unit formula $$R_aSiO_{(4-a)/2}, \qquad \text{(II)}$$

in which R is an unsubstituted or substituted monovalent hydrocarbon group having 1 to 14 carbon atoms and the subscript a is a positive number in the range from 1.95 to 2.20. Examples of suitable R groups are those selected from the class consisting of alkyl groups such as methyl, ethyl, propyl, butyl, octyl, decyl and dodecyl groups, alkenyl groups such as vinyl and allyl groups and aryl groups such as phenyl and tolyl groups as well as those groups obtained by substituting halogen atoms and the like for a part or all of the hydrogen atoms in the above named hydrocarbon groups such as chloromethyl, chlorophenyl, trifluoropropyl and perfluoroalkyl groups. The subscript a in the formula is a positive number in the range from 1.95 to 2.20. The silicone fluid preferably has a viscosity in the range from 100 to 1,000,000 centistokes or, more preferably, in the range from 1,000 to 500,000 centistokes at 25° C. When the silicone fluid has a viscosity too low, the fluid is practically not suitable for use as a viscous damper fluid due to the poor damping effect and, in addition, due to the increased rate of settling of the cyclooctene compound once dispersed therein. Needless to say, a fluid having an excessively high viscosity is not suitable for use as a damper fluid.

On the other hand, the cyclootene compound as the component (B) in the silicone-based working fluid of the invention is represented by the above given structural formula (I). A commercial product suitable for the purpose is supplied by Hooker Chemicals Corp., U.S.A,. with a trade name of Dechlorane Plus.

The cyclooctene compound is a solid lubricant and preferably is in a particulate form having an average particle diameter of 5 μm or smaller in view of the dispersibility in the silicone fluid. The amount of the cyclooctene compound to be added preferably in the range from 5 to 50 parts by weight or, more preferably, in the range from 10 to 30 parts by weight per 100 parts by weight of the silicone fluid as the component (A). When the amount thereof is too small, the desired effect of improvement in the lubricity of the silicone fluid cannot be obtained as a matter of course. On the other hand, an excessively large amount of the cyclootene compound added to the silicone fluid causes an undue increase in the viscosity or consistency of the fluid so that the composition is no longer suitable as a working fluid due to the loss of good flowability.

The silicone-based working fluid composition of the invention can be obtained by adding a specified amount of the above-described cyclooctene compound in a powdery form to the aforementioned silicone fluid as the component (A) and uniformly mixing them together. By virtue of the improved performance of boundary lubrication obtained by the addition of the cyclooctene compound, damper units filled with the inventive silicone-based working fluid composition would provide various advantages in industrial uses including reduction of the amount of metals worn off by friction between metals, long-term stability of the output performance and, furthermore, excellent durability and thermal stability as a consequence of the low vapor pressure and high heat resistance of the cyclooctene compound. The silicone-based working fluid of the invention may be admixd optionally with various kinds of known additives including rust inhibitors, antioxidants, dyes, pigments and the like.

The silicone-based working fluid composition of the invention is described in more detail by way of examples, in which the term of "parts" always refers to "parts by weight" and the values of viscosity are all those obtained by the measurement at a temperature of 25° C.

EXAMPLES 1 TO 5 AND COMPARATIVE EXAMPLES 1 AND 2

The above described Dechlorane Plus #1000 having an average particle diameter of about 2 μm was added, in an amount shown in Table 1 in each of these examples, to 100 parts of a dimethylpolysiloxane fluid having a viscosity of 103,000 centistokes and terminated at each molecular chain end with a trimethyl siloxy group, which is referred to as the silicone fluid I hereinbelow, or a methyl phenyl polysiloxane fluid having a viscosity of 9,800 censtistokes and terminated at each molecular chain end with a trimethyl siloxy group, of which the content of the phenyl groups relative to all of the hydrocarbon groups was 5% by moles, which is referred to as the silicone fluid II hereinbelow. Each of the five mixtures was stirred for 1 hour at room temperature and kneaded three times using a three-roll mill to give a silicone-based working fluid. These working fluids were subjected to a four-ball friction test to evaluate the lubrication performance by determining the load for seizure. The testing conditions were as shown below and the results are shown in Table 1.

Testing conditions

| | |
|---|---|
| Velocity of revolution | 1,000 rpm |
| Testing time | 5 minutes |
| Temperature | room temperature |

For comparison in Comparative Examples 1 and 2, the same four-ball friction test was undertaken for the silicone fluids I and II without addition of the additive to give the results of the load for seizure also shown in Table 1.

TABLE 1

| Silicone fluid | Dechlorane Plus added, parts | Load for seizure, kg |
|---|---|---|
| I | 20 | 90 |
| I | 10 | 50 |
| I | 15 | 63 |
| II | 30 | 140 |
| II | 17 | 79 |
| I | 0 | 40 |
| II | 0 | 32 |

What is claimed is:

1. A silicone-based working fluid composition which comprises (A) a conventional silicone fluid having a viscosity suitable for use in a working fluid and (B) an amount effective to improve the boundary lubrication and durability of the working fluid of 1,2,3,4,8,9,10,13,13,14,14-dodecachloro-1,4,4a,5,6-,6a,7,10,10a,11,12,12 a-dodecahydro-1,4:7.10-dimethanodibenzo[a,e]cyclooctene expressed by the structural formula

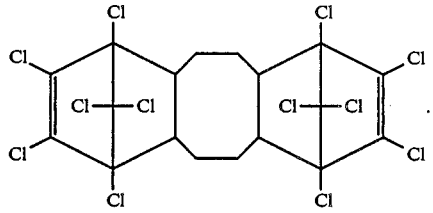

2. The silicone-based working fluid composition according to claim 1 which comprises, in admixture: 100 parts by weight of the silicone fluid as the component (A) having a viscosity in the range from 100 to 1,000,000 centistokes at 25° C. represented by the average unit formula $$R_aSiO_{(4-a)/2},$$

in which R is an unsubstituted or substituted monovalent hydrocarbon group having 1 to 14 carbon atoms and the subscript a is a positive number in the range from 1.95 to 2.20; and from 5 to 50 parts by weight of the component (B).

3. The silicone-based working fluid composition according to claim 2, in which the amount of the component (B) is in the range from 10 to 30 parts by weight per 100 parts by weight of the component (A).

4. The silicone-based composition according to claim 3, in which the component (B) is in particulat form having an average particle diameter of 5 μm or smaller.

5. The silicone-based composition according to claim 4, in which the component (A) has a viscosity in the range from 1,000 to 500,000 centistokes at 25° C.

* * * * *